US010925372B2

(12) United States Patent
Calhoun

(10) Patent No.: US 10,925,372 B2
(45) Date of Patent: Feb. 23, 2021

(54) DISPENSING BRUSH ASSEMBLY

(71) Applicant: Troy Calhoun, Country Club Hills, IL (US)

(72) Inventor: Troy Calhoun, Country Club Hills, IL (US)

( * ) Notice: Subject to any disclaimer, the term of this patent is extended or adjusted under 35 U.S.C. 154(b) by 523 days.

(21) Appl. No.: 15/678,251

(22) Filed: Aug. 16, 2017

(65) Prior Publication Data

US 2019/0053598 A1 Feb. 21, 2019

(51) Int. Cl.
*A45D 24/28* (2006.01)
*A46B 11/00* (2006.01)

(52) U.S. Cl.
CPC ..... *A45D 24/28* (2013.01); *A46B 11/0027* (2013.01); *A46B 2200/104* (2013.01)

(58) Field of Classification Search
CPC .... A45D 2019/0033; A45D 2019/0041; A45D 2019/0083; A45D 19/02; A45D 24/00; A45D 24/22; A45D 24/28; A45D 2/002; A45D 2007/002; A45D 27/04; A45D 33/24; A45D 34/042; A46B 11/0027; A46B 11/00; A46B 2200/104; A46B 11/0031; A46B 2200/1033; A46B 2200/3006; A46B 2200/2013; B65D 47/185; B65D 83/0033; B05B 11/00416; A47G 19/24
USPC ..... 132/107, 112, 120, 122, 148, 221; 401/277, 175, 137, 270, 130, 264, 11, 401/282, 291; 222/166, 536, 628, 631, 222/575, 352, 386, 485; 239/87; D4/114, 128, 133
See application file for complete search history.

(56) References Cited

U.S. PATENT DOCUMENTS 51,509 A * 12/1865 Colburn ..... B65D 47/185 239/374
55,008 A * 5/1866 Gannett ..... B65D 47/185 239/374
231,950 A * 9/1880 Ames ..... B65D 47/185 239/374
883,331 A * 3/1908 McClelland ..... B65D 47/185 239/374
1,221,578 A 4/1917 O'Connell
(Continued)

FOREIGN PATENT DOCUMENTS

CN 203424550 U * 2/2014 ..... A46B 11/02
GB 2304033 A * 8/1995 ..... A46B 11/02
(Continued)

OTHER PUBLICATIONS http://www.spraynozzlesindia.com/multiple-full-cone-spray-nozzles.html (Year: 2019).*
(Continued)

*Primary Examiner* — Yogesh P Patel
*Assistant Examiner* — Jennifer Gill

(57) ABSTRACT

A dispensing brush assembly containing and selectively dispensing a hair care product includes a brush that is selectively manipulated thereby facilitating the brush to groom hair. The brush has a reservoir therein to contain a fluid. A plunger unit is movably coupled to the brush and the plunger unit is selectively manipulated. The plunger unit is in fluid communication with the reservoir to selectively urge the fluid outwardly from the brush. In this way the fluid may be urged onto the hair to enhance grooming.

6 Claims, 4 Drawing Sheets

(56) References Cited

U.S. PATENT DOCUMENTS 1,355,973 A * 10/1920 Hollingsworth ..... B65D 47/185 239/374
1,810,074 A * 6/1931 Friedlander ..... A46B 11/0041 401/288
1,893,191 A * 1/1933 Wuest ..... A46B 11/0027 401/173
2,071,101 A * 2/1937 Anderson ..... B65D 47/185 239/559
2,235,637 A 3/1941 Kickey
2,559,757 A * 7/1951 Chandler ..... B08B 9/0436 401/9
2,652,283 A * 9/1953 Roop ..... D06F 87/00 239/374
2,666,940 A * 1/1954 Davison ..... A46B 11/0027 401/175
2,727,787 A * 12/1955 Mauzy ..... B65D 47/185 239/327
2,973,538 A * 3/1961 Thomson ..... A47L 13/22 401/286
3,009,190 A * 11/1961 Awot ..... A47L 1/08 401/46
3,896,822 A * 7/1975 Zimmerman ..... A46B 5/00 15/104.94
4,288,169 A * 9/1981 McMenamin, IV ..... A46B 11/0027 401/175
4,332,250 A * 6/1982 Behney ..... A61D 11/00 401/282
5,289,833 A 3/1994 McDonald
D346,958 S * 5/1994 Olson ..... D32/35
D362,501 S * 9/1995 Louviere ..... D24/115
D411,409 S * 6/1999 Wallays ..... D7/391
5,975,089 A 11/1999 Simon
5,979,463 A * 11/1999 Santy ..... A45D 24/16 132/120
6,047,703 A 4/2000 Paglericcio et al.
D457,730 S 5/2002 McCurrach
D479,801 S * 9/2003 Carmichael ..... D7/401.1
6,974,092 B1 * 12/2005 Leventhal ..... A46B 11/0017 239/302
7,261,108 B2 8/2007 Dallianis et al.
7,785,026 B2 * 8/2010 Eng ..... A45D 34/04 401/25
9,210,982 B2 * 12/2015 Alsalameh ..... A46B 11/0041 401/288
D855,393 S * 8/2019 Johnston ..... D7/401.1
2001/0047807 A1 * 12/2001 Berke ..... A45D 34/04 132/112
2002/0085875 A1 * 7/2002 Karvelas ..... A46B 11/0027 401/291
2003/0221699 A1 * 12/2003 Battaglia ..... A46B 11/0017 132/112
2008/0166172 A1 * 7/2008 Eng ..... A45D 34/04 401/37
2008/0317544 A1 * 12/2008 Spirk ..... A45D 27/04 401/277
2012/0207531 A1 * 8/2012 Rusev ..... A45D 34/042 401/175
2015/0272313 A1 * 10/2015 Alsalameh ..... A45D 19/02 401/28
2017/0112333 A1 * 4/2017 McCauley ..... A47K 7/043

FOREIGN PATENT DOCUMENTS

GB 2370757 * 7/2002 ..... A46B 11/00
WO WO2008021641 2/2008

OTHER PUBLICATIONS https://www.tecpro.com.au/product/d-two-piece-full-cone-nozzle/cay-cluster-full-cone-nozzle/ (Year: 2019).*

* cited by examiner

DISPENSING BRUSH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to brush devices and more particularly pertains to a new brush device for containing a selectively dispensing a hair care product.

BRIEF SUMMARY OF THE INVENTION

An embodiment of the disclosure meets the needs presented above by generally comprising a brush that is selectively manipulated thereby facilitating the brush to groom hair. The brush has a reservoir therein to contain a fluid. A plunger unit is movably coupled to the brush and the plunger unit is selectively manipulated. The plunger unit is in fluid communication with the reservoir to selectively urge the fluid outwardly from the brush. In this way the fluid may be urged onto the hair to enhance grooming.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
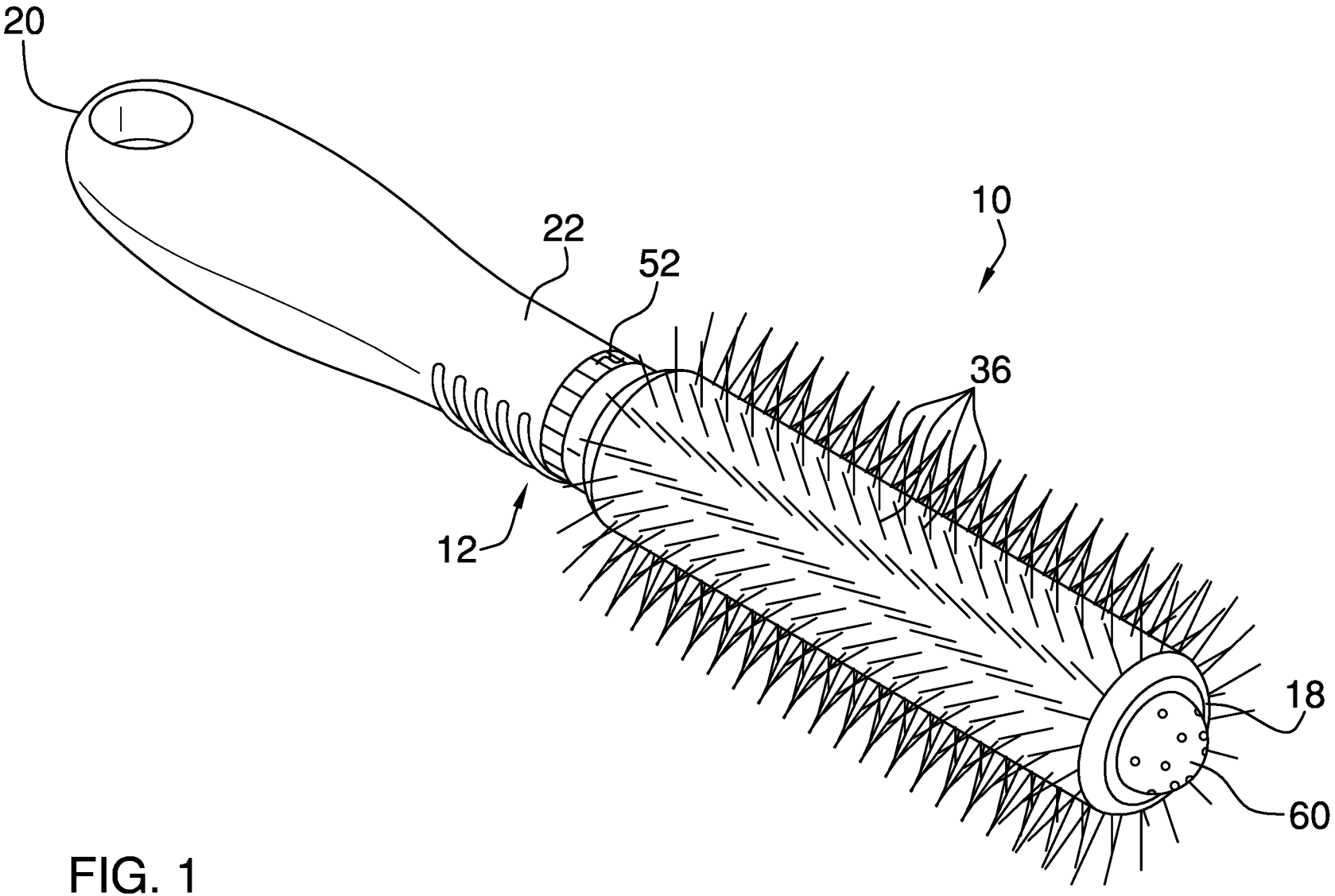
FIG. 1 is a perspective view of a dispensing brush assembly according to an embodiment of the disclosure.
Figure 2:
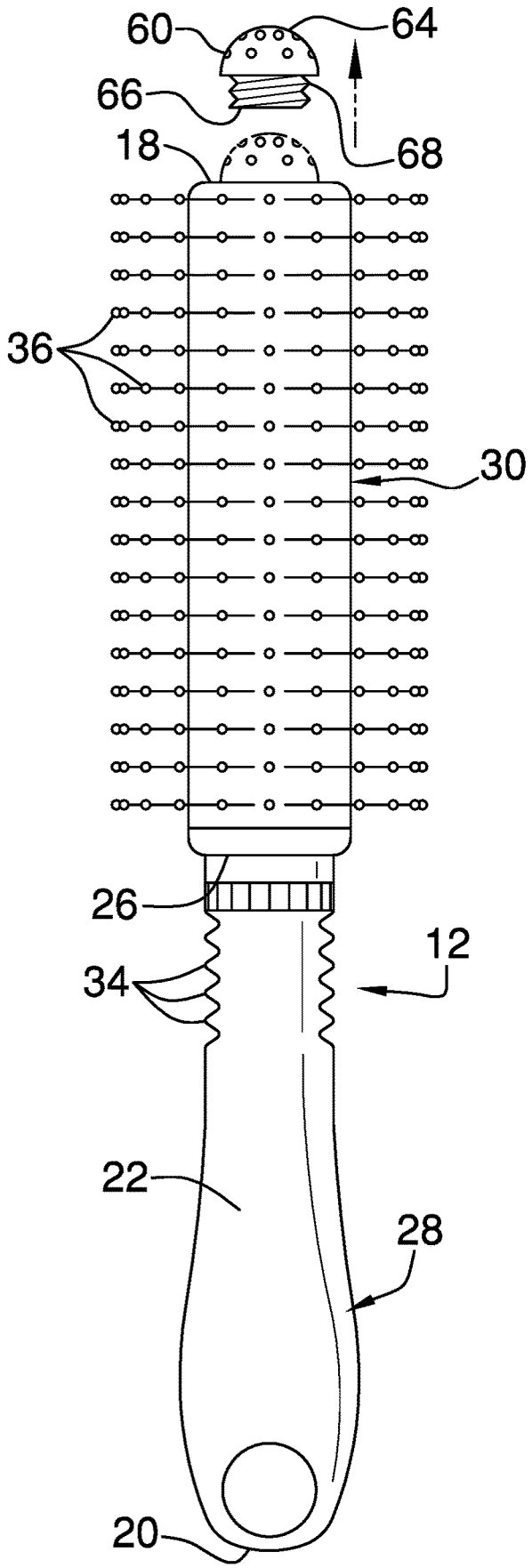
FIG. 2 is a front view of an embodiment of the disclosure.
Figure 3:
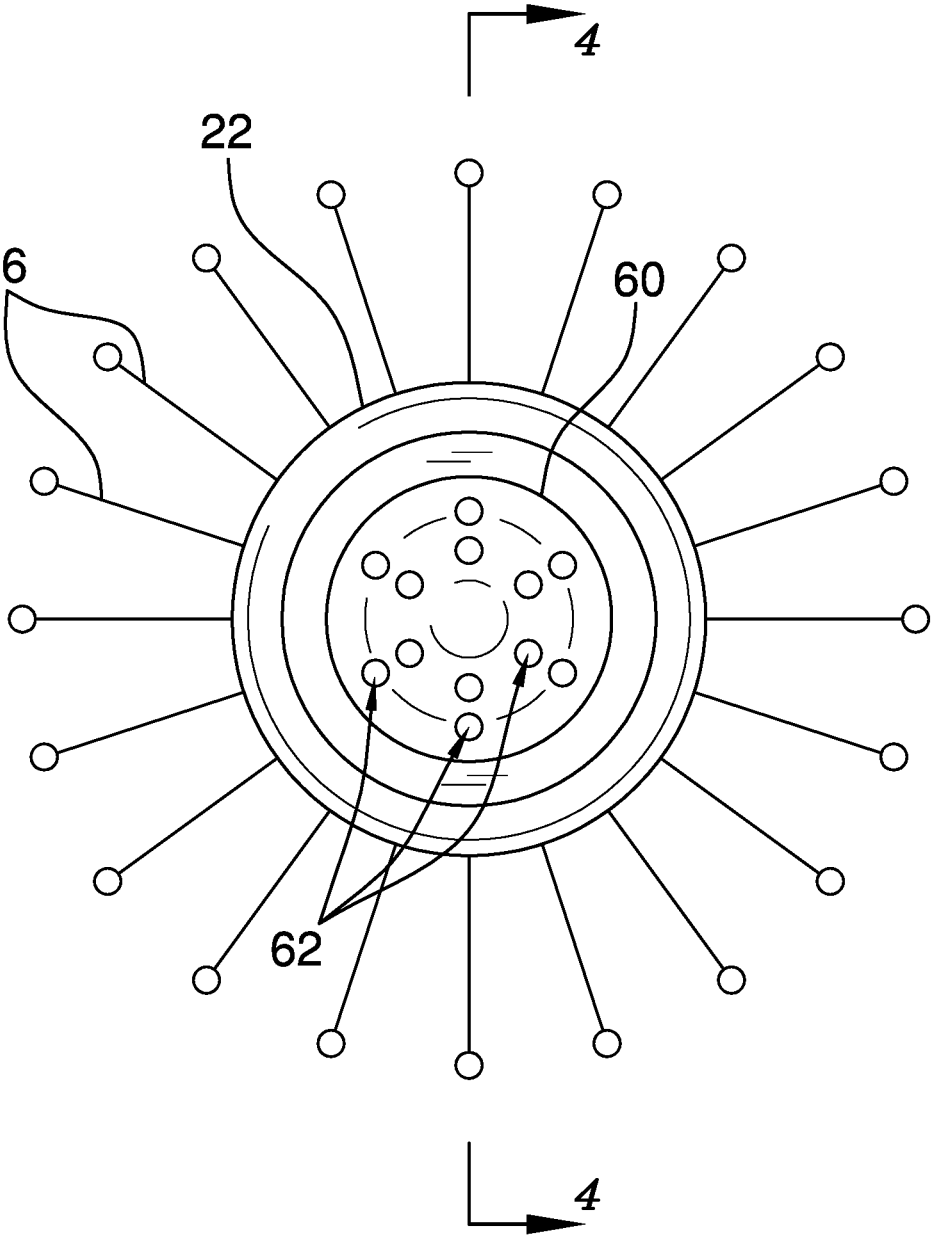
FIG. 3 is a top view of an embodiment of the disclosure.
Figure 4:
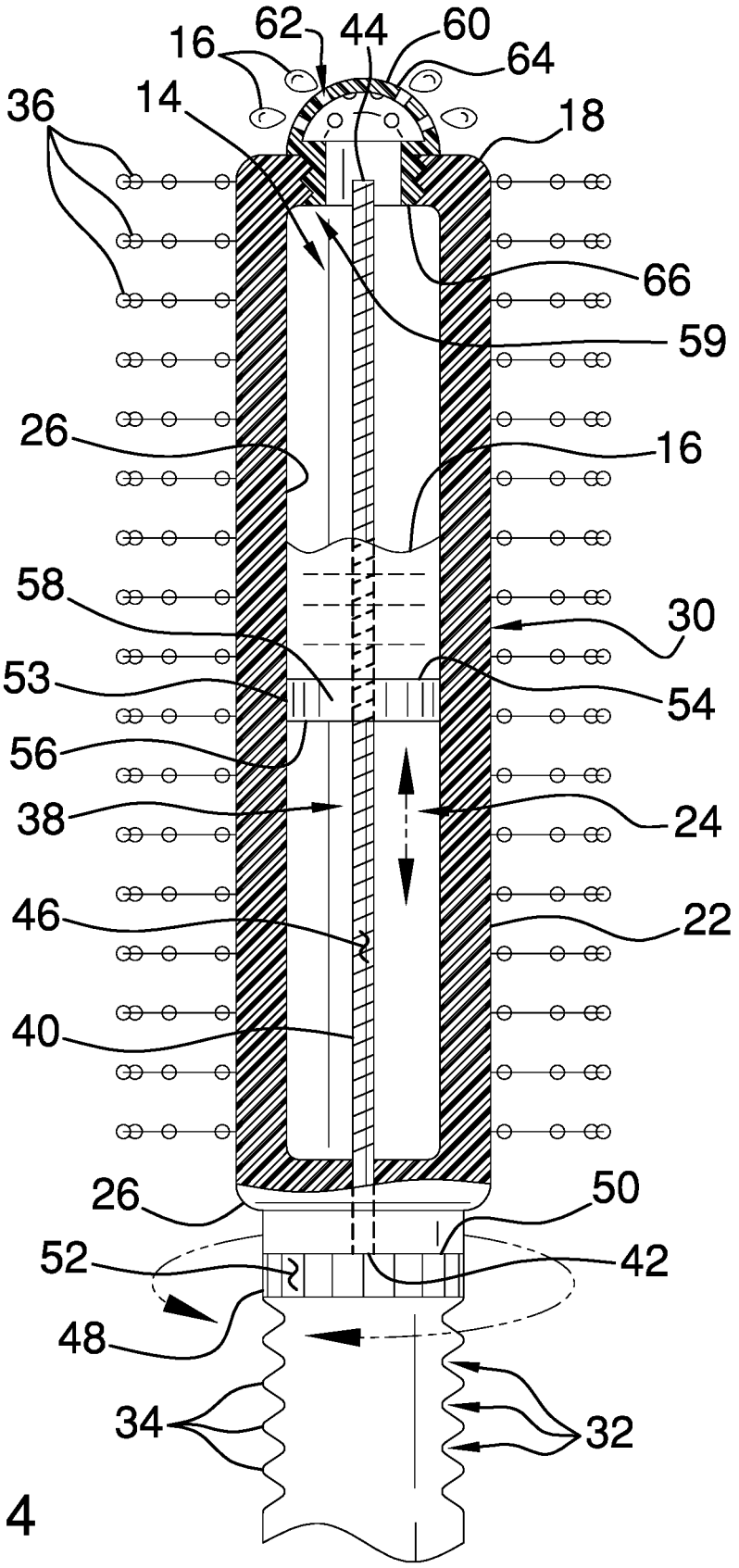
FIG. 4 is a cross sectional view taken along line 4-4 of FIG. 3 of an embodiment of the disclosure.

With reference now to the drawings, and in particular to FIGS. 1 through 4 thereof, a new brush device embodying the principles and concepts of an embodiment of the disclosure and generally designated by the reference numeral 10 will be described.

As best illustrated in FIGS. 1 through 4, the dispensing brush assembly 10 generally comprises a brush 12 that is selectively manipulated to groom hair. The brush 12 has a reservoir 14 therein to contain a fluid 16. The fluid 16 may be a fluid hair care product such as hair gel or the like. The brush 12 has a first end 18, a second end 20 and an outer wall 22 extending therebetween. The outer wall 22 is continuous such that the brush 12 has a cylindrical shape. The first end 18 has a well 24 extending toward the second end 20 such that the well 24 defines the reservoir 14.

The outer wall 22 has a bounding surface 26 extending between a first half 28 and a second half 30 of the brush 12. The first half 28 is gripped and the well 24 is positioned in the second half 30. The outer wall 22 corresponding to the first half 28 has a plurality of depressions 32 extending therearound to define a plurality of ribs 34. The ribs 34 are spaced apart from each other and are distributed from the bounding surface 26 of the brush 12 toward the second end 20. A plurality of bristles 36 is provided and each of the bristles 36 is coupled to and extends outwardly from the outer wall 22 to groom the hair. Each of the bristles 36 is spaced apart from each other and is distributed around the outer wall 22 corresponding to the second half 30 of the brush 12.

A plunger unit 38 is movably coupled to the brush 12 and the plunger unit 38 is selectively manipulated. The plunger unit 38 is in fluid 16 communication with the reservoir 14. Moreover, the plunger unit 38 selectively urges the fluid 16 outwardly from the brush 12 when the plunger unit 38 is manipulated. In this way the fluid 16 is urged onto the hair to enhance grooming.

The plunger unit 38 comprises a screw 40 that is positioned within the reservoir 14. The screw 40 has a primary end 42, a secondary end 44 and an outside surface 46 extending therebetween. The outside surface 46 is threaded between the primary end 42 and the secondary end 44. A wheel 48 is provided that has a front surface 50 and a peripheral surface 52. The wheel 48 is rotatably coupled to the first half 28 of the brush 12 and the peripheral surface 52 extends outwardly through the outer wall 22 of the brush 12. Thus, the peripheral edge 52 selectively manipulated thereby facilitating the wheel 48 to be rotated. The primary end 42 of the screw 40 is coupled to the front surface 50 of the wheel 48 such that the wheel 48 rotates the screw 40 when the wheel 48 is rotated.

A disk 53 is provided that has a first surface 54, a second surface 56 and an exterior edge 58 extending therebetween. The screw 40 extends through the first 54 and second 56 surfaces of the disk 53 such that the disk 53 threadably engages the screw 40. The exterior edge 58 frictionally engages a bounding surface 59 of the well 24. Moreover, the disk 53 forms a fluid 16 impermeable seal between the disk 53 and the well 24.

The wheel 48 is selectively rotated in a first direction and a second direction. The disk 53 is urged along the screw 40 toward the first end 18 of the brush 12 when the wheel 48 is rotated in the first direction. Thus, the disk 53 urges the fluid 16 outwardly through the first end 18 of the brush 12. The disk 53 is urged along the screw 40 toward the second end 20 of the brush 12 when the wheel 48 is rotated in the second direction.

A cap 60 is removably coupled to the brush 12 to close the reservoir 14. The cap 60 has a plurality of openings 62 therein to pass the fluid 16 outwardly therefrom when the plunger unit 38 is manipulated. The cap 60 has a first end 64, a second end 66 and an outer wall 68 extending therebetween. The second end 66 of the cap 60 is open and each of the openings 62 extends through the first end 18 of the cap 60. The first end 64 of the cap 60 is concavely arcuate with respect to the second end 66 of the cap 60 to radiate the fluid 16 outwardly from the brush 12. The outer wall 68 of the cap 60 is threaded to threadably engage the bounding surface 59 of the well 24 to close the first end 18 of the brush 12.

In use, the wheel 48 is rotated in the second direction to position to disk 53 at a bottom of the well 24. The well 24 is filled with the fluid 16 and the cap 60 is coupled to the brush 12. The wheel 48 is selectively rotated in the first direction when the brush 12 is manipulated to groom the hair. Thus, the fluid 16 is dispensed onto the hair to enhance grooming the hair. Moreover, the plunger unit 38 facilitates the fluid 16 to be dispensed onto the hair without using hands. In this way the plunger unit 38 enhances cleanliness with respect to dispensing the fluid 16 onto the hair.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dispensing brush assembly being configured to contain and selectively dispense a fluid, said assembly comprising:

a brush being configured to groom hair, said brush having a well therein wherein said well is configured to contain a fluid, said brush having a first end, a second end and an outer wall extending therebetween, said outer wall being continuous and imperforate such that said brush has a cylindrical shape, said well extending from said first end of said brush toward said second end of said brush, outer wall having a bounding surface extending between a first half and a second half of said brush, said first half being configured to be gripped, said well being positioned in said second half;

a plunger unit being movably coupled to said brush wherein said plunger unit is configured to be manipulated, said plunger unit being in fluid communication with said well wherein said plunger unit is configured to selectively urge the fluid outwardly from said brush thereby facilitating the fluid to be urged onto the hair to facilitate grooming;

a plurality of bristles, each of said bristles being coupled to and extending outwardly only from said outer wall wherein each of said bristles is configured to groom the hair, each of said bristles being spaced apart from each other and being distributed around said outer wall corresponding to said second half of said brush; and a cap being removably coupled to said brush to cover said well, said cap having a plurality of openings therein wherein each of said openings is configured to pass the fluid outwardly therefrom when said plunger unit is manipulated, said cap having a first end, a second end and an outer wall extending therebetween, said second end of said cap being open, each of said openings extending through said first end of said cap, said first end of said cap being concavely arcuate with respect to said second end of said cap wherein said first end of said cap is configured to radiate the fluid outwardly from said first end of said brush.

2. The assembly according to claim 1, wherein said plunger unit comprises a screw being positioned within said well, said screw having a primary end, a secondary end and an outside surface extending therebetween, said outside surface being threaded between said primary end and said secondary end.

3. The assembly according to claim 2, wherein the plunger unit further comprises a wheel having a front surface and a peripheral surface, said wheel being rotatably coupled to said first half of said brush having said peripheral surface extending outwardly through said outer wall of said brush wherein said peripheral surface is configured to be manipulated thereby facilitating said wheel to be rotated.

4. The assembly according to claim 3, wherein said primary end of said screw is coupled to said front surface of said wheel such that said wheel rotates said screw when said wheel is rotated.

5. The assembly according to claim 1, wherein said outer wall of said cap is threaded, said outer wall threadably engaging a bounding surface of said well such that said cap covers said first end of said brush.

6. A dispensing brush assembly being configured to contain and selectively dispense a fluid, said assembly comprising:

a brush being configured to groom hair, said brush having a well therein wherein said well is configured to contain a fluid, said brush having a first end, a second end and an outer wall extending therebetween, said outer wall being continuous and imperforate such that said brush has a cylindrical shape, said well extending from said first end of said brush toward said second end of said brush, outer wall having a bounding surface extending between a first half and a second half of said brush, said first half being configured to be gripped, said well being positioned in said second half;

a plurality of bristles, each of said bristles being coupled to and extending outwardly only from said outer wall wherein each of said bristles is configured to groom the hair, each of said bristles being spaced apart from each other and being distributed around said outer wall corresponding to said second half of said brush;

a plunger unit being movably coupled to said brush wherein said plunger unit is configured to be manipulated, said plunger unit being in fluid communication with said well wherein said plunger unit is configured to selectively urge the fluid outwardly from said brush thereby facilitating the fluid to be urged onto the hair to facilitate grooming, said plunger unit comprising:

a screw being positioned within said well, said screw having a primary end, a secondary end and an outside surface extending therebetween, said outside surface being threaded between said primary end and said secondary end, a wheel having a front surface and a peripheral surface, said wheel being rotatably coupled to said first half of said brush having said peripheral surface extending outwardly through said outer wall of said brush wherein said peripheral surface is configured to be manipulated thereby facilitating said wheel to be rotated, said primary end of said screw being coupled to said front surface of said wheel such that said wheel rotates said screw when said wheel is rotated, and a disk having a first surface, a second surface and an exterior edge extending therebetween, said screw extending through said first and second surfaces of said disk such that said disk threadably engages said screw, said exterior edge frictionally engaging a bounding surface of said well to form a fluid impermeable seal between said disk and said well, said disk being urged along said screw when said wheel is rotated wherein said disk is configured to selectively urge the fluid outwardly through said first end of said brush; and a cap being removably coupled to said brush to cover said well, said cap having a plurality of openings therein wherein each of said openings is configured to pass the fluid outwardly therefrom when said plunger unit is manipulated, said cap having a first end, a second end and an outer wall extending therebetween, said second end of said cap being open, each of said openings extending through said first end of said cap, said first end of said cap being concavely arcuate with respect to said second end of said cap wherein said first end of said cap is configured to radiate the fluid outwardly from said first end of said brush, said outer wall of said cap being threaded, said outer wall threadably engaging a bounding surface of said well such that said cap covers said first end of said brush.

* * * * *